US005745546A

United States Patent [19]

Hell et al.

[11] Patent Number: 5,745,546

[45] Date of Patent: Apr. 28, 1998

[54] ANODE FOR AN X-RAY TUBE

[75] Inventors: Erich Hell, Erlangen; Manfred Fuchs, Nuernberg, both of Germany

[73] Assignee: Siemens Aktiengesellschaft, Munich, Germany

[21] Appl. No.: 613,724

[22] Filed: Mar. 12, 1996

[30] Foreign Application Priority Data

Mar. 20, 1995 [DE] Germany ..... 195 10 047.6

[51] Int. Cl.[6] ..... H01J 35/08

[52] U.S. Cl. ..... 378/143; 378/10

[58] Field of Search ..... 378/143, 144

[56] References Cited

U.S. PATENT DOCUMENTS

| | | | |
|---|---|---|---|
| 1,174,044 | 3/1916 | Benson . | |
| 2,071,696 | 2/1937 | Jonas . | |
| 2,521,663 | 9/1950 | Zunich | 378/143 |
| 3,683,223 | 8/1972 | Dietz | 378/143 |
| 4,182,955 | 1/1980 | Davis | 378/143 |
| 4,439,870 | 3/1984 | Poulsen et al. | 378/143 |

FOREIGN PATENT DOCUMENTS

| | | |
|---|---|---|
| 0 455 177 | 11/1991 | European Pat. Off. . |
| 619 562 | 9/1935 | Germany . |
| 1 469 932 | 4/1977 | United Kingdom . |
| 1 604 431 | 12/1981 | United Kingdom . |

*Primary Examiner*—Craig E. Church
*Attorney, Agent, or Firm*—Hill, Steadman & Simpson

[57] ABSTRACT

An anode for an x-ray tube has an incident surface on which an electron beam is incident for generating x-rays emanating from a focal spot. In at least that region wherein the focal spot is located during operation of the x-ray tube, the incident surface has a step-like structure with end faces that reside at a substantially right angle relative to the electron beam during operation of the x-ray tube. The end faces are connected by respective sidewalls, and backscattered electrons from the end faces strike the sidewalls and generate x-rays in addition to x-rays emanating from the end faces struck by the electron beam, thereby improving the efficiency of x-ray generation. A similar improvement can be achieved by an anode having a roughened surface in the region of the focal spot.

14 Claims, 6 Drawing Sheets

ANODE FOR AN X-RAY TUBE

BACKGROUND OF THE INVENTION

1. Field of the Invention

The present invention is directed to an anode for an x-ray tube having an incident surface for an electron beam, from which x-rays emanate from the point of incidence of the electron beam during operation of the x-ray tube.

2. Description of the Prior Art

When electrons are incident onto a material having the atomic umber Z, then a portion $\eta$ of the electrons, which is also referred to as backscatter coefficient, is scattered back. As may be seen from Table 1, the backscatter coefficient is only slightly dependent on the electron energy E but highly dependent on the atomic number Z of the material. The backscatter coefficient $\eta$ is likewise highly dependent on the angle $\Phi$ between the electron path and the surface normal at the point of incidence (see FIG. 1 ). The average energy of the backscatter electrons increases steadily with the atomic number Z of the material of the incident surface and amounts to about 90% of the incident energy for elements with a high atomic number Z.

As may be seen from FIG. 1, the incident angle $\Phi$ is thus of great significance for the efficiency in generating x-radiation with an electron beam incident on an anode target composed, for example, of tungsten (Z=74). The incident angle $\Phi$ should not become larger than 30° since, as may be seen from FIG. 1, the backscatter coefficient $\Phi$ otherwise increases dramatically, and the backscattered electrons only heat the anode, and/or lead to extrafocal radiation.

The electron beam source of an x-ray tube and the electron optics, which, if present, are disposed following downstream from the electron source, are therefore generally fashioned and arranged such that a critical incident angle $\Phi_{crit}$ of 30° is not exceeded. In conventional x-ray tubes, this arrangement can normally be realized in a simple way. There are, however, applications such as, for example, ring x-ray tubes required for electron beam tomography (see, for example, European Application 0 455 177) wherein upward transgressions of the critical incident angle $\Phi_{crit}$ can be only avoided with substantial outlay.

German Patent 619 562 and U.S. Pat. No. 2,071,696 disclose enlarging the area of the region of the incident surface charged by the electron beam without optical spreading and distortion of the focal spot by grooving the region of the focal spot. A higher thermal loadability of the focal spot can be achieved in this way, but not an increase in the efficiency of the x-ray generation.

Great Britain Patent Specification 1 469 932 discloses a rotating anode x-ray tube whose focal spot is periodically displaced by deflection of the electron beam transversely relative to the circumferential direction of the rotating anode for achieving an increased thermal loadability. In order to cause the focal spot to appear stationary despite its displacement, the anode has an incident surface provided with a grooved structure. Additionally, a defined relationship of the deflection frequency of the electron beam to the rotational speed of the rotating anode and a defined phase relation between the deflection frequency of the electron beam and the rotational speed of the rotating anode are maintained. An increase in the efficiency in generating the x-radiation cannot be achieved in this way.

Great Britain Patent Specification 1 604 431 discloses a fixed anode x-ray tube whose focal spot is periodically displaced by deflection of the electron beam on the incident surface for achieving increased thermal loadability, the displacement ensuing transversely relative to the direction of ribbing provided on the anode surface in the region of the focal spot. In order to avoid thermal overloads in the region of the peaks of the ribbing, the dislocation of the focal spot ensues in steps such that the focal spot dwells in the valleys of the ribbing but quickly sweeps over the peaks of the ribbing. Again an increase in the efficiency in generating the x-radiation cannot be achieved in this way.

U.S. Pat. No. 1,174,044 discloses a fixed anode x-ray tube wherein the incident surface of the anode is provided with serrations in the region of the focal spot. Each serration is formed by a first surface and second surface. These surfaces are arranged such that the electron beam is incident only onto the first surface of each serration. The x-radiation emanates from the respective first surfaces, while the second surfaces respectively occlude a part of this x-radiation. Improved imaging properties are intended to be achieved by this structure, however, an increase in the efficiency in generating the x-radiation cannot be achieved in this way.

SUMMARY OF THE INVENTION

It is an object of the present invention to provide an anode on which electrons are incident for producing x-rays emanating from a focal spot, wherein a high efficiency is achieved in generating the x-radiation.

This object is inventively achieved in an anode for an x-ray tube, having an incident surface on which an electron beam is incident in a focal spot, at least that region of the anode surface in which the focal spot is located during operation of the x-ray tube having a step-like structure with end faces that reside substantially at a right angle to the electron beam path during operation of the x-ray tube, and having sidewalls connecting the end faces to one another, the sidewalls being arranged such that electrons that are backscattered from the end faces during operation of the x-ray tube and that are incident onto the sidewalls, contribute to the x-ray generation. As a result of such a stepped structure of the anode, the minimally obtainable backscatter coefficient, for the particular material of the incident surface and the particular electron energy present during operation of the x-ray tube, is at least approximately achieved. A further enhancement of the quantum yield is achieved as a result of the sidewalls connecting the end faces to one another and struck by the electrons backscattered from the end faces during operation of the x-ray tube, since the electrons incident on the sidewalls also contribute to the generation of x-radiation. For enhancing the efficiency of the x-ray generation in an existing x-ray tube, it thus suffices to provide the incident surface of the anode thereof with the step-like structure. If the step-like structure is thereby fashioned such that its envelope corresponds to the contour of the incident surface of the existing anode, no modifications other than the modification of the anode by attaching the step structure thereto are required.

In view of an unimpeded emission of the x-radiation generated in the region of the end face or faces, the angle between end face and sidewall should be at least equal to 90°. In view of the heel effect, the angle between each end face and sidewall is equal to at least 98°.

In order to prevent the step-like structure or surface irregularities in that region wherein the focal spot is located during operation of the x-ray tube from being melted and thus destroyed, the anode in one version of the invention contains a volume for a coolant, for example a channel through which the coolant is conducted (circulated).

The enhancement of the quantum yield by utilizing backscattered electrons can be nearly doubled (for materials having a high atomic number Z) in an embodiment wherein the anode has two incident surface halves that face toward one another.

DESCRIPTION OF THE PREFERRED EMBODIMENTS

Figure 1:
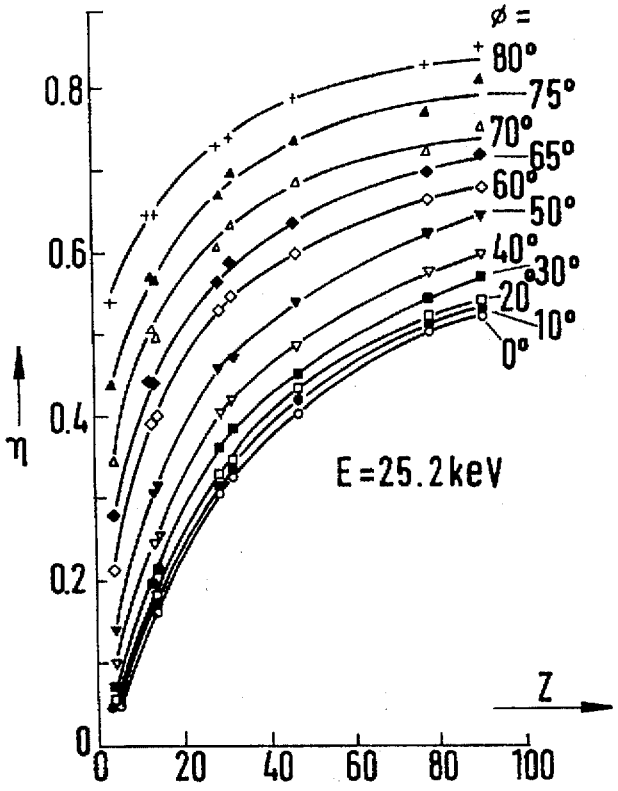
FIG. 1, as noted above, is a diagram showing the dependency of the backscatter coefficient on the atomic number of the target and on the electron beam incident angle.
Figure 2:
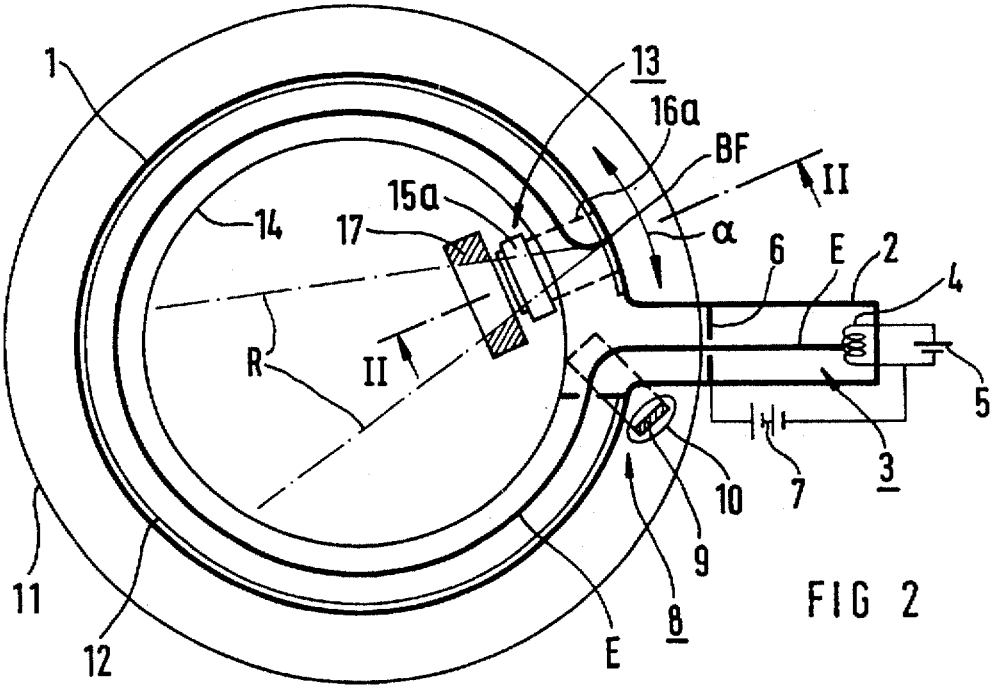
FIG. 2 is a schematic, sectional illustration of an x-ray tube with an inventive anode.

As shown in FIG. 2, an x-ray tube has an annular vacuum housing 1 that is provided with a radially outwardly directed projection 2 in the exemplary embodiment that accepts an electron beam source (generally referenced 3) shielded against electromagnetic disturbances. The projection 2 alternatively can be tangentially or axially oriented.

The electron beam source 3 contains a cathode 4, for example a glow coil, that has a filament voltage source 5 allocated to it. When the filament voltage source 5 is activated, an electron beam E emanates from the cathode 4. This electron beam E is accelerated in a direction toward an apertured diaphragm 6, since an acceleration voltage source 7 is connected between one terminal of the cathode 4 and the apertured diaphragm 6. Magnetic lenses in the form of focusing coils (not shown in FIG. 2) are provided for focusing the electron beam E passing through the apertured diaphragm 6, these focusing the electron beam E such that it has a substantially constant, preferably elliptical, or circular cross-section. "Constant" means constant with respect to the shape and area content of the electron beam along its entire length.

First deflection means that are stationary with respect to the vacuum housing 1 and that deflect the electron beam E such that it subsequently traverses a circular path within the annular vacuum housing 1 are arranged in the region of the transition of the projection 2 into the annular vacuum housing 1. In the exemplary embodiment, the first deflection means are formed by an electromagnet 8 that has a yoke 9 (for example, U-shaped) that carries a winding 10 embracing the vacuum housing 1 and that generates a magnetic field directed at a right angle relative to the plane of the drawing with reference to FIG. 2.

A diaphragm which sets the desired monochromatic electron energy is provided inside the annular vacuum housing 1 at the beginning of the annular path of the electron beam. Moreover, the electromagnet 10 simultaneously selects the electrons according to their energy in case the energy of the electrons is no longer mono-energetic as a result of impacts with residual gas which may be present in the vacuum housing 1.

A schematically indicated Helmholtz coil pair 11, that generates a magnetic field that likewise at a right angle to the plane of the drawing of FIG. 2 but opposite the magnetic field of the electromagnet 10 is provided in order to hold the electron beam on its circular path.

A target 12 that extends along the outside wall of the vacuum housing 1 is provided inside the annular vacuum housing 1 as anode. The target contains a material, for example tungsten, that is suitable for x-ray emission.

Second deflection means, preferably in the form of a deflection magnet 13, are provided in order to be able to deflect the electron beam E out of its circular path onto the target 12 in the way required for generating x-radiation. The magnetic field thereof is opposite the magnetic field of the Helmholtz coil pair 11 and therefore it deflects the electron beam E radially outwardly, so that it strikes the target 12 in a focal spot BF.

The x-radiation emitted from the focal spot BF passes through an annular beam exit window 14 forming the inside wall of the vacuum housing 1, that is formed of a suitable material with a low atomic number, for example beryllium.

In the exemplary embodiment, the deflection magnet is implemented as an electromagnet that has two windings **15*a* and 15*b* applied on respective yokes 16*a* and 16*b*. As may be seen from FIG. 3, the yokes 16*a* and 16*b***—which are connected to one another in a way that is not shown—also blank out stray and extrafocal radiation.

Figure 3:
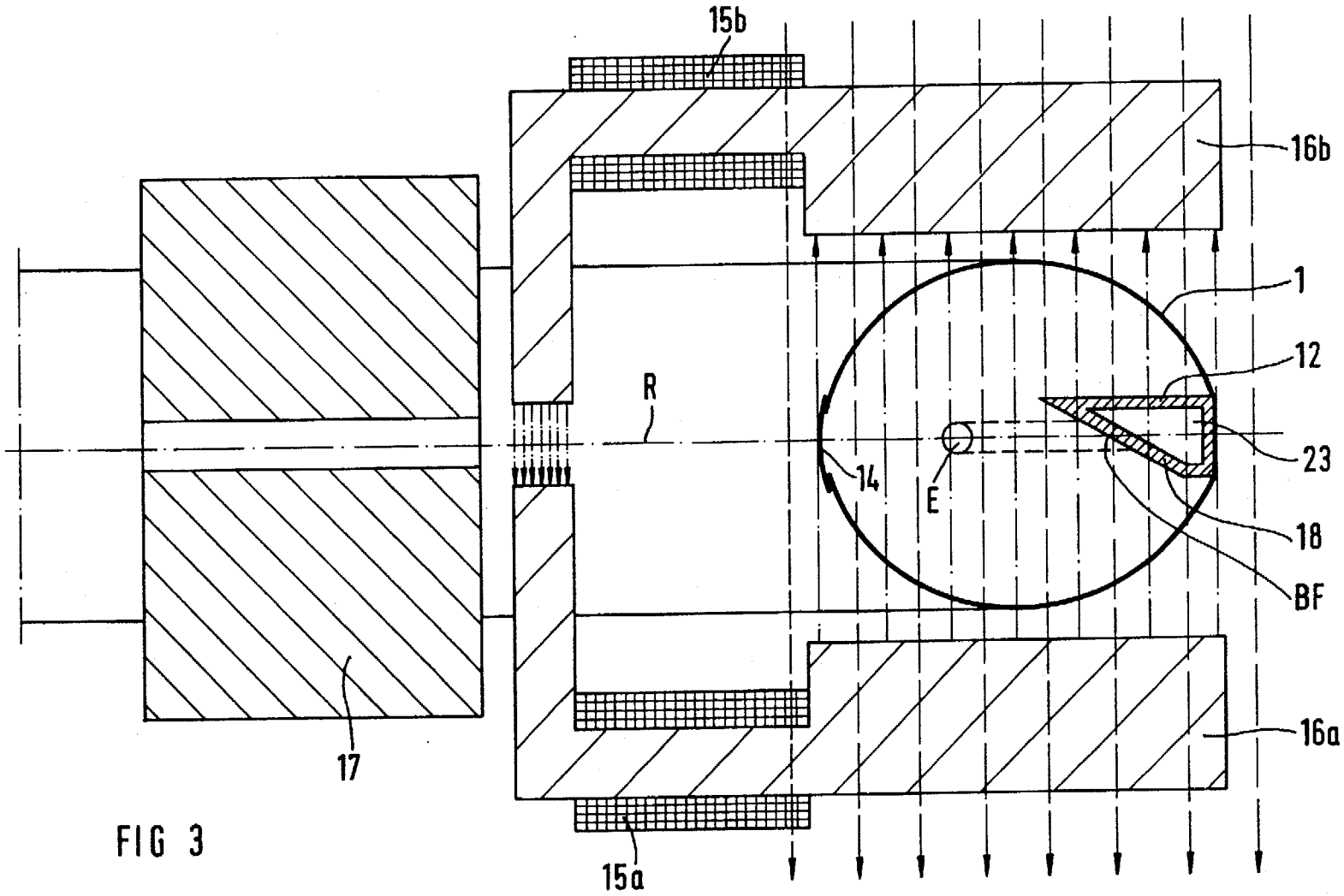
FIG. 3 is a section along line III—III of FIG. 2, shown enlarged.

As shown in FIG. 3, a collimator 17 for the x-radiation emanating from the focal spot BF is provided in the exemplary embodiment. As becomes clear in conjunction with FIG. 2, the collimator 17 in the exemplary embodiment gates the x-radiation such that a fan-shaped x-ray beam as required for computed tomography, is formed.

In FIG. 3, moreover, the field lines of the magnetic field of the Helmholtz coil pair 11 are entered with dashed lines and those of the deflection magnet 13 are entered dot-dashed, the arrows indicating the direction of the respective magnetic fields.

In order to be able to simply and precisely displace the focal spot BF on a circular path along the circumference of the target 12 in the way required for computed tomography, the deflection magnet 13 together with the collimator 17 are adjustable along the circumference of the vacuum housing 1 with adjustment means (not shown in detail in FIGS. 2 and 3), as a result of which the focal spot BF is analogously displaced along the circumference of the target 12 corresponding to the position of the deflection magnet 13.

As may be seen from FIG. 3, the electron beam E strikes the incident surface 18 of the target 12 in the focal spot BF with an angle between the surface normal N and the electron path that is inherently unbeneficial in view of the backscatter coefficient $\eta$.

Figure 4:
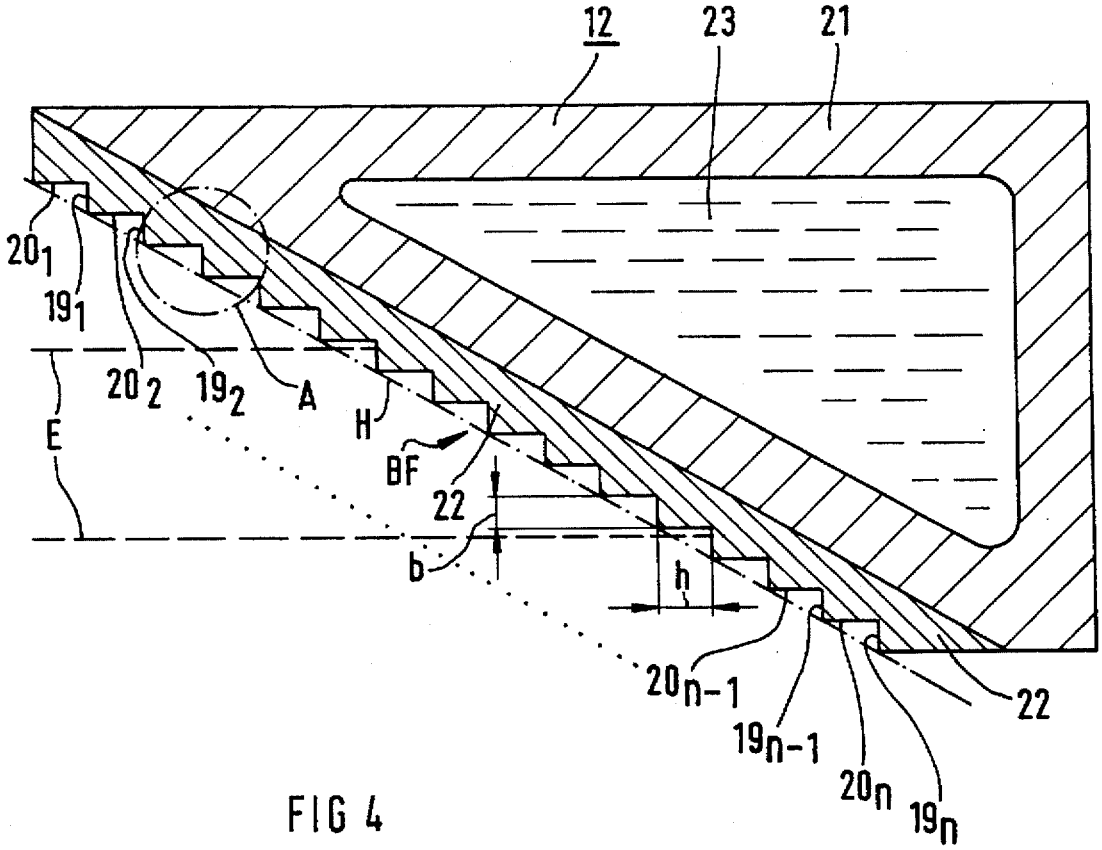
FIG. 4 shows the anode of the x-ray tube of FIGS. 1 and 2 in cross-section, enlarged further.

In order nonetheless to achieve good efficiency in generating the x-radiation, the incident surface 18 of the target 12 in the inventive x-ray tube is provided—according to FIG. 4—along its circumference with a structure that is step-like in cross-section and that has end faces ($\mathbf{19}_1$ through $\mathbf{19}_n$) that reside substantially perpendicularly to the x-ray beam E, i.e. to the incident direction of the electrons, during operation of the x-ray tube. As a result, the minimal backscatter coefficient for the material in the region of the incident surface of the respective target is at least approximately realized. The end faces $\mathbf{19}_1$ through $\mathbf{19}_n$ are connected such to one another via sidewalls $\mathbf{20}_1$ through $\mathbf{20}_n$ that the envelope H of the step-like structure corresponds at least approximately to the cross-sectional contour of the incident surface 18.

Figure 5:
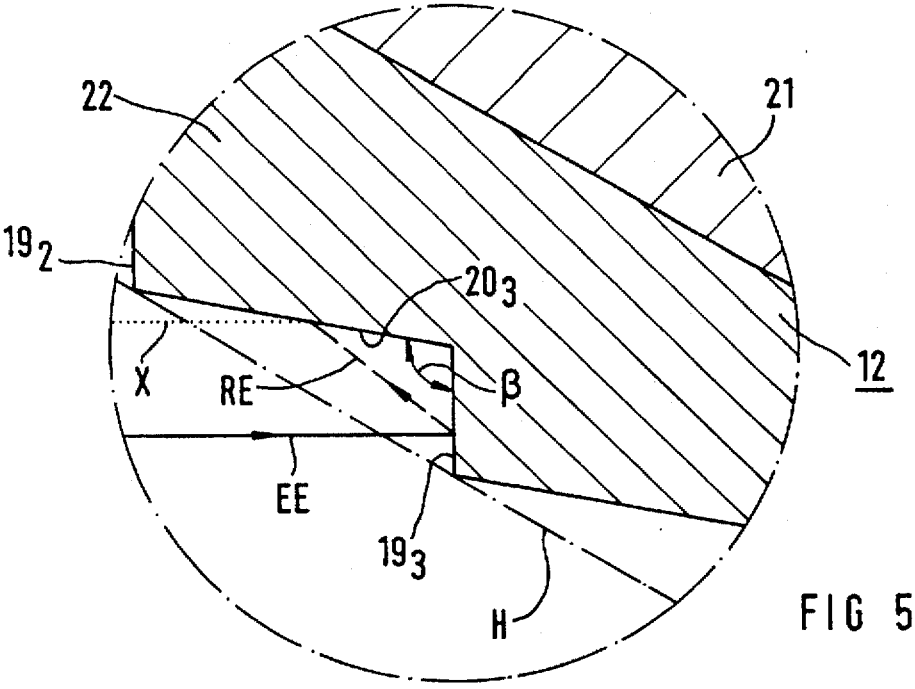
FIG. 5 shows the detail A of FIG. 4, enlarged further.

Enhancement of the quantum yield is also achieved because electrons RE backscattered from an end face are incident onto a sidewall and contribute at the sidewall at the x-ray generation X as indicated in FIG. 5 for the end face $\mathbf{19}_3$ and the sidewall $\mathbf{20}_3$ with reference to the example of an incident electron EE. In the described exemplary embodiment, the angle β between end faces $\mathbf{19}_1$ through $\mathbf{19}_n$ and sidewalls $\mathbf{20}_1$ through $\mathbf{20}_n$ amounts to at least 98° in view of the heel effect.

The enhancement of the quantum yield by the contribution of the sidewalls $\mathbf{20}_1$ through $\mathbf{20}_n$ is calculated as follows:

$$P_{SF}=1{,}1\cdot 10^{-9}\cdot U\cdot Z\cdot I\cdot(1-\eta) \quad (1)$$

which is valid for the radiation capacity $P_{SF}$ emanating from the sum of the end faces.

$$P_{SW}=1{,}1\cdot 10^{-9}\cdot U\cdot Z\cdot I\frac{1}{2}\cdot\int_{\phi=\frac{\pi}{2}}^{\phi\,\min}\frac{1}{2}\cdot\eta\cdot\cos\phi\cdot\left(1-\frac{\eta}{\sin\frac{\phi}{3}}\right)\cdot d\phi$$

is valid for the radiation capacity $P_{SW}$ emanating from the sidewalls.

$$\tfrac{1}{2}\cdot\eta\cdot(1-\eta) \quad (3)$$

is the limit value for the integral over a half-space of the backscattered electrons contained in Equation (2).

The following limit value $$\Delta\epsilon_1=\frac{P_{SW}}{P_{SF}}\leqq\frac{\frac{1}{2}\cdot\eta\cdot(1-\eta)}{1-\eta}=\frac{1}{2}\cdot\eta$$

thus derives as the limit value for the quantum yield increase $\Delta\epsilon_1$ that can be achieved with a step-shaped structure.

In Equations (1) through (4)

U=tube voltage,

Z=atomic number of the material of the target in the region of the incident surface, I=tube current, η=backscatter coefficient, ϕ=incident angle $\Phi_{min}$=minimum angle between the normal of the sidewall and the incident direction of the backscatter electrons.

ϕ=incident angle $\Phi_{min}$=minimum angle between the normal of the sidewall and the incident direction of the backscatter electrons.

The solution of the integral in Equation (2) for tungsten (η=0.45) yields a quantum yield increase $\Delta\epsilon_1$ of 0.08, i.e. 8%, at the same tube voltage and same cathode current for a relationship of the width b of the end faces $\mathbf{19}_1$ through $\mathbf{19}_n$ to the height h of the sidewalls $\mathbf{20}_1$ through $\mathbf{20}_n$(shaft ratio) of 12, and thus a value for $\Phi_{min}$ of 1.53 rad.

Instead of a step structure, the incident surface 18 can have an extremely rough surface with a surface roughness on the order of magnitude of 5 μm through 50 μm. As roughly schematically indicated in FIG. 6, a reduced, average backscatter coefficient and an enhanced quantum yield as a result of the roughness then also arise compared to a macroscopically geometrically similar incident surface despite the lack of defined end faces and defined sidewalls.

Figure 7:
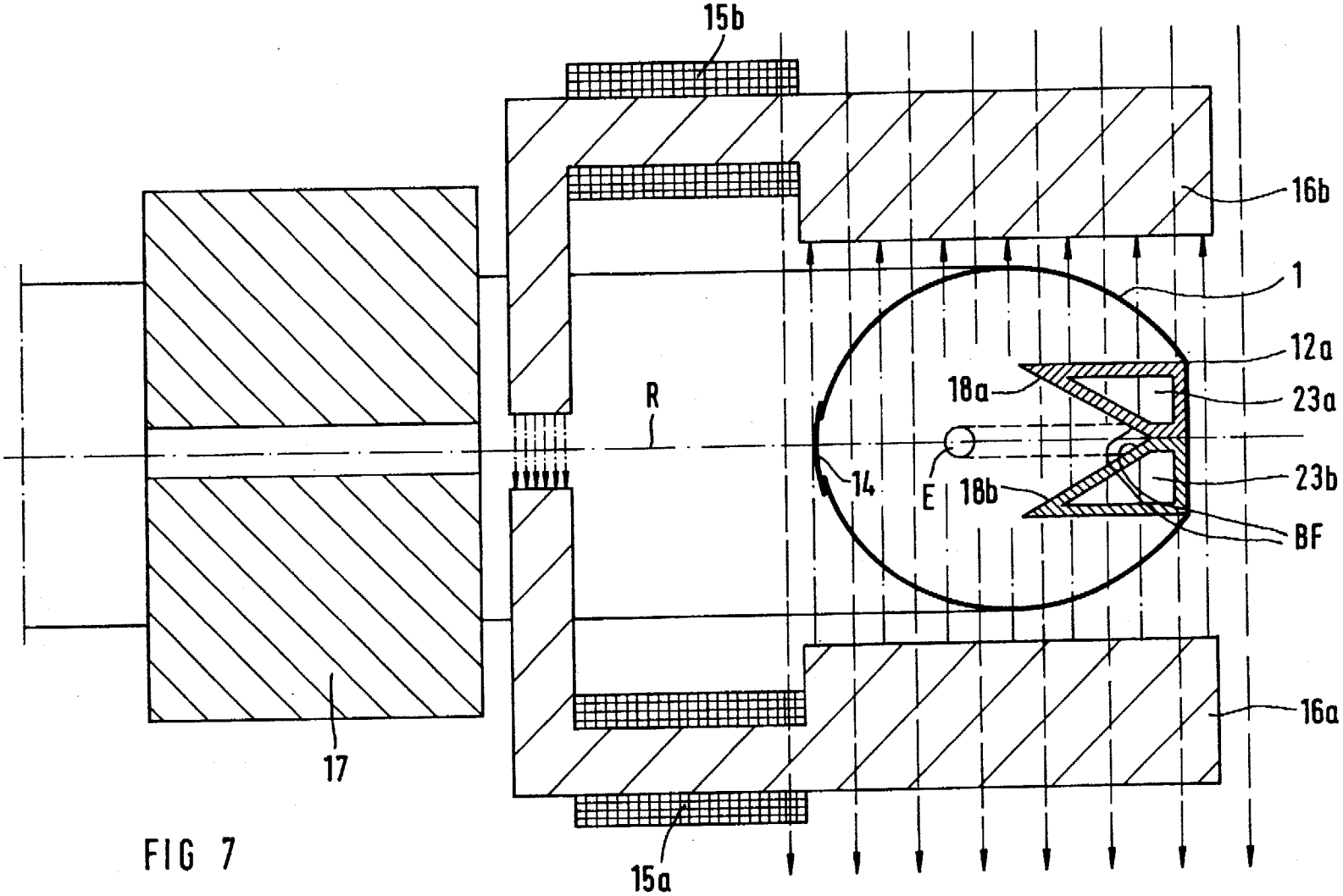
FIGS. 7 and 8 show a further version of an x-ray tube with an inventive anode in illustrations respectively analogous to FIGS. 3 and 4.
Figure 8:
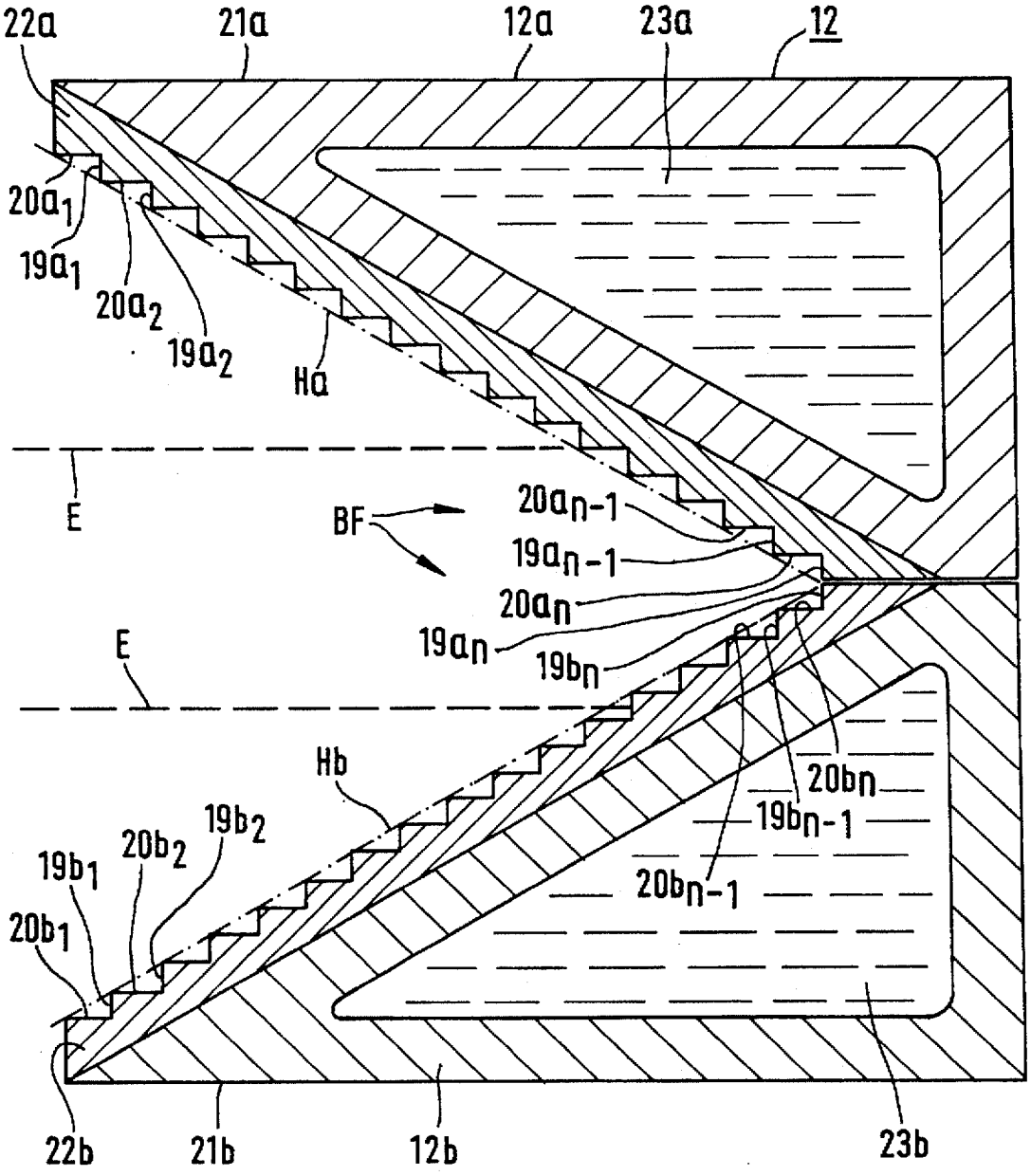

A further enhancement of the quantum yield is possible when, according to FIGS. 7 and 8, two identical target halves 12*a* and 12*b* are employed, their incident surface halves being implemented as stepped structures with end faces $\mathbf{19}a_1$ through $\mathbf{19}a_n$,or $\mathbf{9}b_1$ through $\mathbf{19}b_1$, and sidewalls $\mathbf{20}a_1$ through $\mathbf{20}a_n$, or $\mathbf{20}b$ through $\mathbf{20}b_n$, whose envelopes are oppositely inclined with reference to the electron beam ES.

$$\Delta\epsilon_2=\frac{P_{SW}}{P_{SF}}\leqq\frac{\eta\cdot(1-\eta)}{1-\eta}=\eta$$

is then valid as the quantum yield increase $\Delta\epsilon_2$. Double the quantum yield increase thus derives.

Figure 6:
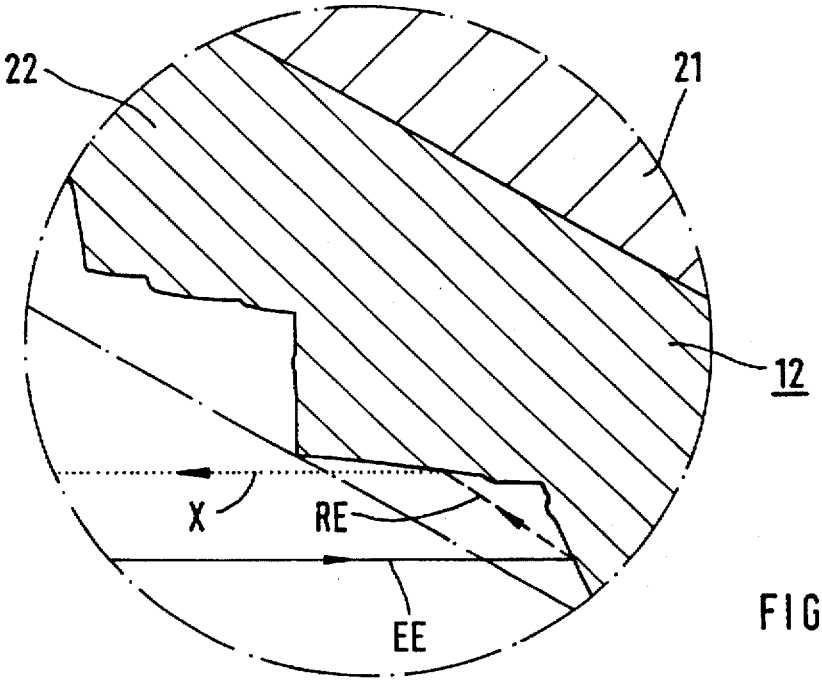
FIG. 6 illustrates a modification of the anode of FIG. 5 in a representation analogous to FIG. 5.

Instead of two target halves with step-shaped incident surface halves two target halves with roughened incident halves according to FIG. 6 or one anode half with a step-shaped and one with a roughened incident surface half can be provided.

The target 12 or the target halves 12*a* and 12*b* are respectively of a base member 21, or base members 21*a* and 21*b*, composed of a highly thermally conductive material, for example copper, and are provided with a coat 22, or coats 22*a* and 22*b* composed of a material suitable for generating x-rays, for example tungsten, that forms the incident surface 18, or the incident surface halves 18*a* and 18*b*. A thin coat 22 or 22*a* and 22*b* having a thickness of 10 μm through 50 μm thereby suffices, and this can be vapor-deposited on the base members 21 or 21*a* and 21*b* or can be welded thereon in the form of a thin sheet.

In order to prevent the step-like structure or the roughness from being melted in the region of the incident surface 18 or the incident surface halves 18*a* and 18*b* due to thermal influence, the base member 21 or base members 21*a* and 21*b* can be provided with a cooling channel 23, or channels 23*a* and 23 *b*, in which a fluid coolant flows.

In the exemplary embodiment, the step-like structure or the roughness is present over the entire incident surface 18 or over the entire incident surface halves 18*a* and 18*b*. It is sufficient, however, to provide the step-like structure or the roughness only in that region of the incident surface 18 or of the incident surface halves 18*a* and 18*b*, in which the focal spot BF can be located during operation of the x-ray tube.

The invention was described above with reference to the example of a ring x-ray tube of the type employed for electron beam tomography. It is also possible to provide fixed anode as well as rotating anode x-ray tubes with inventively fashioned anodes as disclosed herein.

Although modifications and changes may be suggested by those skilled in the art, it is the intention of the inventors to embody within the patent warranted hereon all changes and modifications as reasonably and properly come within the scope of their contribution to the art.

We claim as our invention:

1. In an x-ray tube having an electron source which emits an electron beam and having an anode with an incident surface on which said electron beam is incident at a focal spot with x-rays emanating from said focal spot, the improvement comprising:

said anode having a region of said surface at least coinciding with said focal spot during operation of said x-ray tube having a step-like structure formed by a plurality of end faces disposed substantially at a right angle to, and being struck by, said electron beam during operation of said x-ray tube for producing x-rays, and said region having a plurality of sidewalls respectively connecting said end faces, each sidewall being disposed at an angle of substantially 98° relative to an end face connected thereto so that electrons backscattered from said end faces during operation of said x-ray tube are incident on said sidewalls and said sidewalls producing x-rays upon being struck by said backscattered electrons.

2. The improvement of claim 1 wherein an angle between each end face and each side wall is substantially 98°.

3. The improvement of claim 1 further comprising means in said anode for containing a coolant.

4. The improvement of claim 1 wherein said anode comprises an incident surface containing said region formed by two incident surface halves facing one another.

5. The improvement of claim 1 wherein:

said region of said surface at least coinciding with said focal spot during operation of said x-ray tube has a surface roughness in a range between 5 μm and 50 μm.

6. In an x-ray tube having an electron source which emits an electron beam and having an anode with an incident surface on which said electron beam is incident at a focal spot with x-rays emanating from said focal spot, the improvement comprising:

said anode having a region of said surface at least coinciding with said focal spot during operation of said x-ray tube having a step-like structure including means formed by a plurality of end faces disposed substantially at a right angle to, and being struck by, said electron beam during operation of said x-ray tube for producing backscattered electrons and a first contribution of x-rays to an x-ray beam, and means for producing a second contribution of x-rays to said x-ray beam comprising a plurality of sidewalls respectively connecting said end faces and disposed so that said backscattered electrons are incident on said sidewalls for producing said second contribution of x-rays.

7. The improvement of claim 6 further comprising means in said anode for containing a coolant.

8. The improvement of claim 6 wherein said anode comprises an incident surface containing said region formed by two incident surface halves facing one another.

9. The improvement of claim 6 wherein said region of said surface at least coinciding with said focal spot during operation of said x-ray tube has a surface roughness in a range between 5 μm and 50 μm.

10. An x-ray tube comprising:

an electron source which emits an electron beam;

means for guiding said electron beam in a substantially circular path around an examination region;

an anode having an incident surface struck by said electron beam at a focal spot, said anode having a region of said surface at least coinciding with said focal spot having a step-like structure including a plurality of end faces;

means for deflecting said electron beam out of said generally circular path onto said end faces at substantially a right angle to said end faces for producing a first contribution to an x-ray beam directed into said examination region and for producing backscattered electrons; and said region of said surface of said anode also including a plurality of sidewalls respectively connecting said end faces, each side wall being disposed at an angle relative to an end face connected thereto so that electrons backscattered from said end faces are incident on said sidewalls, said sidewalls comprising means for producing a second contribution of x-rays to said x-ray beam directed into said examination region, upon being struck by said backscattered electrons.

11. An x-ray tube as claimed in claim 10 wherein said angle comprises an angle of substantially 98°.

12. The improvement of claim 10 further comprising means in said anode for containing a coolant.

13. The improvement of claim 10 wherein said anode comprises an incident surface containing said region formed by two incident surface halves facing one another.

14. The improvement of claim 10 wherein said region of said surface at least coinciding with said focal spot during operation of said x-ray tube has a surface roughness in a range between 5 μm and 50 μm.

* * * * *